United States Patent [19]

Fuss et al.

[11] Patent Number: 5,076,080

[45] Date of Patent: Dec. 31, 1991

[54] LOCKABLE HATCH LATCH

[76] Inventors: Mac Fuss, 2714 Spaulding Cir., Murfreesboro, Tenn. 37130; James B. Fuss, Rte. 1, Box 72C, Cowan, Tenn. 37318

[21] Appl. No.: 654,491

[22] Filed: Feb. 13, 1991

Related U.S. Application Data

[63] Continuation-in-part of Ser. No. 567,083, Aug. 14, 1990, abandoned.

[51] Int. Cl.[5] ..... E05B 33/00; E05C 5/02

[52] U.S. Cl. ..... 70/125; 70/127; 70/208; 70/360; 292/66; 292/DIG. 31

[58] Field of Search ..... 70/117, 127, 128, 208, 70/360, 125, 124, DIG. 78, DIG. 79; 292/66, DIG. 31

[56] References Cited

U.S. PATENT DOCUMENTS

| | | | |
|---|---|---|---|
| 967,377 | 8/1910 | Henry | 292/DIG. 31 X |
| 1,907,625 | 5/1933 | Vogt | 292/62 X |
| 3,402,958 | 9/1968 | Barry | 292/62 |
| 3,438,227 | 4/1969 | Wolniak | 70/208 |
| 4,763,935 | 8/1988 | Bisbing | 292/66 |
| 4,838,054 | 6/1989 | Weinerman et al. | 70/208 |

*Primary Examiner*—Lloyd A. Gall
*Attorney, Agent, or Firm*—Abe Hatcher

[57] ABSTRACT

A hatch latch with a peripheral top surface adapted to fit through an opening in a hatch has a rotatable axial shaft with a latch member toward its lower end, the shaft being partially enclosed in an outer housing and having a central cavity at its upper end surrounded by a groove in the peripheral top surface which makes the hatch latch waterproof by draining water to the periphery by one or more channels leading to an edge of the peripheral top surface. The cavity is adapted to contain a locking device for locking a hatch that needs to be both latched and locked or a plug to fill the top of the cavity when the hatch requires only latching. A bail, D-ring or the like is used to raise and lower the shaft between secured and latched positions and, to rotate the shaft between latched and unlatched positions.

9 Claims, 4 Drawing Sheets

LOCKABLE HATCH LATCH

This is a continuation-in-part of Ser. No. 07/567,083, filed Aug. 14, 1990, now abandoned.

BACKGROUND OF THE INVENTION

1. Field of the Invention

This invention relates to latches. More particularly, it relates to a waterproof lockable hatch latch.

2. Description of the Prior Art

Conventional latches are neither waterproof nor securable without locking. Some hatch latches need to be secured without locking while others require locking with a key. Therefore, there is a need for a general use or all-purpose hatch latch which can be secured with or without locking. The boatman needs to be able to use the same latch on hatches which require locking and those which need only to be secured by latching. The following patents have made steps in this direction by varying the structure of locks and the structure of latches but have so far come up with nothing to solve the foregoing problems. Neyret U.S. Pat. No. 4,759,204 involves a door key lock mechanism of the length of the key involving a plurality of pistons slidable within bores and having a sleeve which plays the part of a conventional rotor. Kelton U.S. Pat. No. 3,964,280 involves a key-operated push-type lock mechanism which actuates the elements of a latch structure into unlatched position when the closure member is to be moved into open position. Foshee U.S. Pat. No. 4,722,204 teaches use of vinyl or like clamp plate and lock cylinder washers in a door lock. Petersdorff U.S. Pat. No. 4,584,856 has to do with a conventional key cylinder lock in a security cover. Wankel el al U.S. Pat. No. 4,907,716 discloses a key-operated bolt movable axially and rotationally to effect a lock action. Franko U.S. Pat. No. 4,462,317 concerns a key-operated lock carried on a cover structure of a lock box. In Sassetti U.S. Pat. No. 2,677,338 is disclosed a key-operated lock with a flanged casing which has a threaded portion adapted to receive nuts. Johnson U.S. Pat. No. 2,819,692 includes a description of a cross bar rotatable with a lock and latch bars pivotally connected to the cross bar. In Russell et al. U.S. Pat. No. 3,503,233 is shown a lock assembly mounted through an opening in a door and having a portion of the lock on one side of the door and fastening means on the other side. Schulz U.S. Pat. No. 4,099,593 depicts a car door which locked by a locking cam received in a slot on an inner shell and a slot on an inwardly extending projection of the door. Schrauder U.S. Pat. No. 702,333 discloses a drawer lock with key, key tumblers and an ornamental ring which can be used in connection with a pull knob. Davis U.S. Pat. No. 4,468,940 shows actuation of a cam lock by a key to cause a latch to rotate and bring about engagement of a prong with an aperture. Wenzel U.S. Pat. No. 4,419,029 has to do with a rotatable D-ring for tightening a threaded fastener which has a recess surrounding a hole in which the fastener is engaged. However none of the foregoing involves or teaches how to make or use a waterproof hatch latch which can be secured by latching only or by latching and locking.

SUMMARY OF THE INVENTION

After extended investigation we have come up with a hatch latch which has inside an outer housing an axial shaft surrounded near its upper end from just inside the outer housing respective outer and inner shells, which may be pressed or pinned together so as to rotate together, the shaft having a latching member toward a lower end thereof which may be made of an adjustable die cast threaded rod. Outer annular portions of the inner shell are connected by a portion extending through the core or axis of the hatch latch which makes the inner shell resemble an "H" in longitudinal cross section. The inner shell has a 90° spiral slot therein in which fits a pin oriented to move along the slot and which in effect lowers the shaft during a first 90° rotation of a bail during an unlatching procedure. Below the inner shell is a fixed annular member which has a circulate slot therein also having a pin. Between the top of the shaft and the portion of the inner shell which extends through the core or axis is a compression spring which, together with the upper part of the shaft, occupy an axial chamber. Above this same inner shell core portion and extending to a top surface of the hatch latch, which, when installed in a hatch extends only slightly above this top surface, is a cavity adapted to hold a key cylinder portion of a locking mechanism, or a plug in the top part of the cavity, depending on whether the hatch latch is to be used in hatches which are to be latched and locked to protect valuable contents of the hatch compartment or only latched and secured. The locking mechanism by which the latch may be locked or unlocked in the embodiment of the invention where such is used may be of a key latch-activating pin type or a spring-loaded type, both operated simply by turning a key inserted into a key slot of a key cylinder to unlock the latch so that the shaft is free, with the aforesaid spring and double pin-in-slot arrangement, to move, first from a shaft-up, securely latched position, down to a latched but unsecured position by turning the bail or D-ring or the like 90° counterclockwise, and then to an unlatched position by turning the bail another 90° counterclockwise.

As just indicated, the hatch latch of the invention has three shaft positions, a shaft-up unlocked and secured position, a shaft-down latched position reached by rotating the bail with the inner and outer shells 90° counterclockwise to drop the shaft by means of a spring above it and a pair of pins and slots in the inner shell and in the fixed annular member below it, respectively, and a shaft-down unlatched position, reached by rotating the shaft, now unlocked so that can be rotated, 90° still counterclockwise to a shell position 180° from the starting shaft-unlocked and secured position. With the shaft in the up secure position and using a key to fit a key cylinder used in place of a plug when it is desired to lock a hatch, the hatch latch of the invention may be locked or unlocked.

A top surface of the hatch latch of the invention has a groove surrounding or encircling the cavity and leading via one or more at least partly sloping channels or slots toward the periphery for draining water off of the surface when the latch is installed on a hatch.

DETAILED DESCRIPTION OF THE INVENTION

Figure 1:
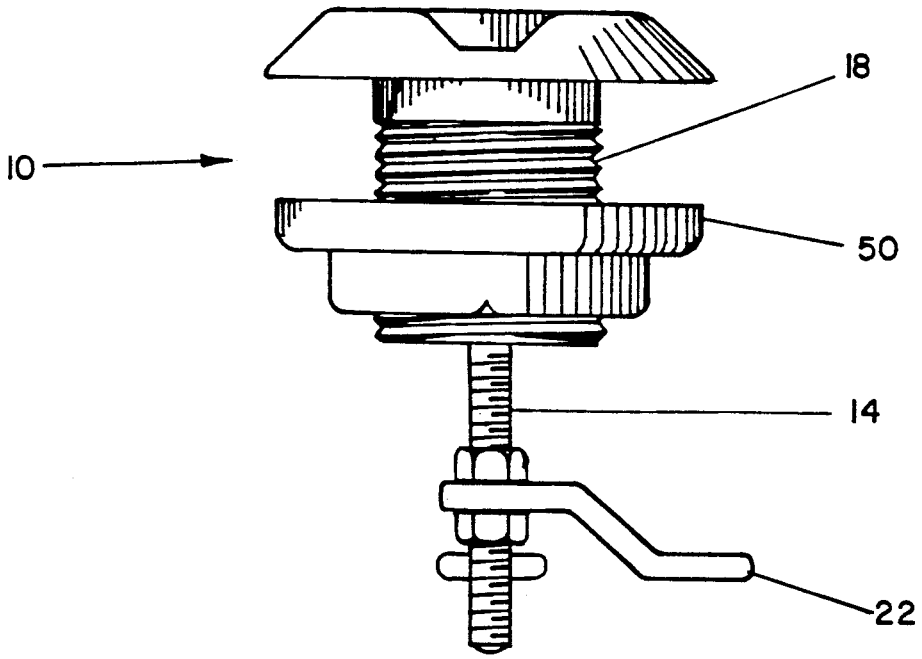
FIG. 1 is a perspective view of the hatch latch of the invention.

For a better understanding of our invention reference will now be made specifically to the drawing which forms a part hereof.

In the drawing, hatch latch 10 has a D-ring, bail or like means 42 for rotating an outer shell 21 which is inside a housing 18, an inner shell 20, which may be press fit or pinned to outer shell 21, and a shaft member or shaft made up of an upper portion and a lower portion 16, which has a latch member 22 extending perpendicularly therefrom. The hatch latch is held in place in a hole through the hatch by an adjustable bolt 50 which fits underneath the hatch cover 52 (FIGS. 3 through 8). Latch member 22 rotates with the shaft 14, 16 when the shaft is free to rotate. Inner shell 20, which has a core or axial portion 23 separating a lower axial chamber 33, which has a compression spring 38 therein, from a cavity 66 thereabove which contains in the upper part thereof 31 a plug (FIG. 6), or, inside a key cylinder 25, occupying most of the cavity 66 a lock pin operator mechanism 64 for moving a spring-loaded rod or pin 32 into and out of slot 19.

Figure 3:
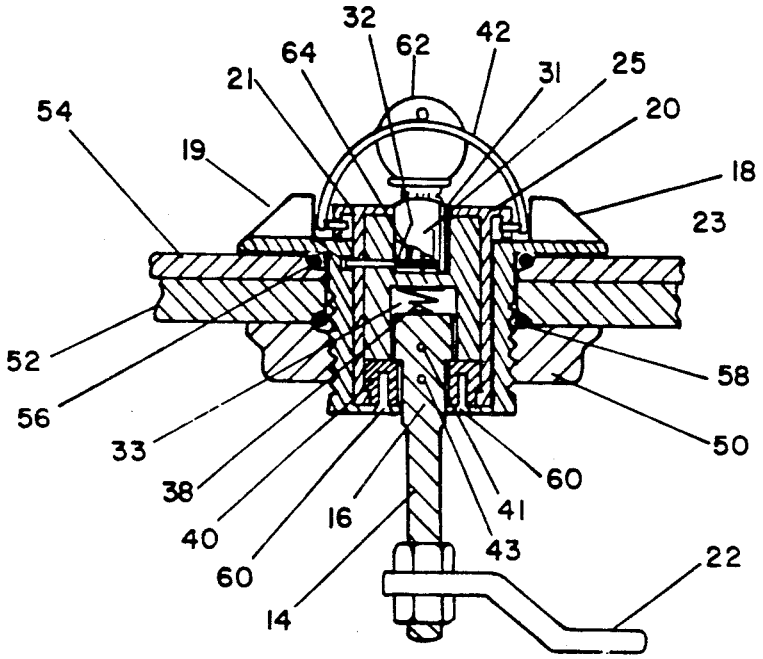
FIG. 3 is principally a longitudinal cross section taken at 3—3 of FIG. 2, with the hatch latch of the invention assembled in an upper latched and secured position in a hole through a carpeted hatch cover and showing a lockrod or lockpin as a part of the locking mechanism, key and key cylinder shown in perspective, the key cylinder being broken away in part to show part of the lockrod-locking mechanism of the invention.
Figure 4:
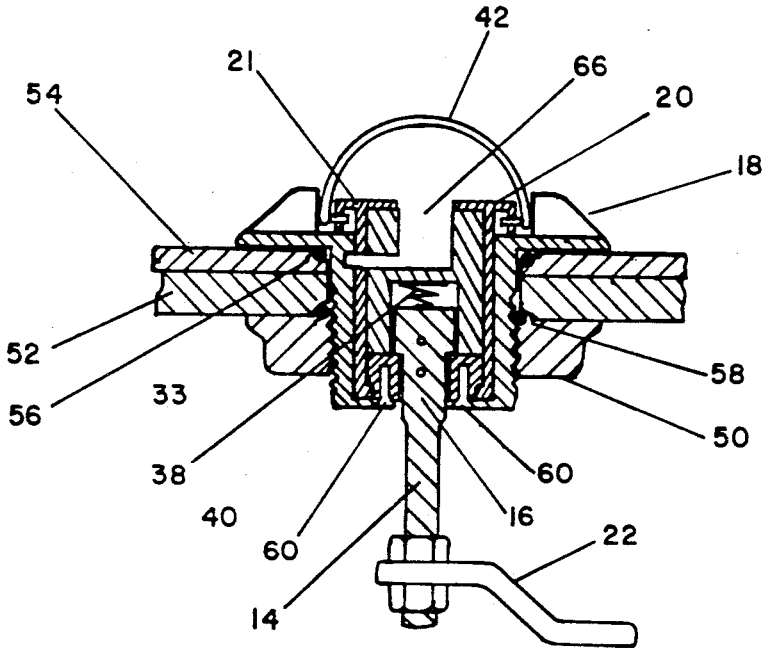
FIG. 4 is similar to FIG. 3 except for showing the hatch latch of the invention as having a cavity instead of a key cylinder with a spring-loaded lockrod-locking mechanism such as that of FIG. 3, which substantially fills a cavity.
Figure 5:
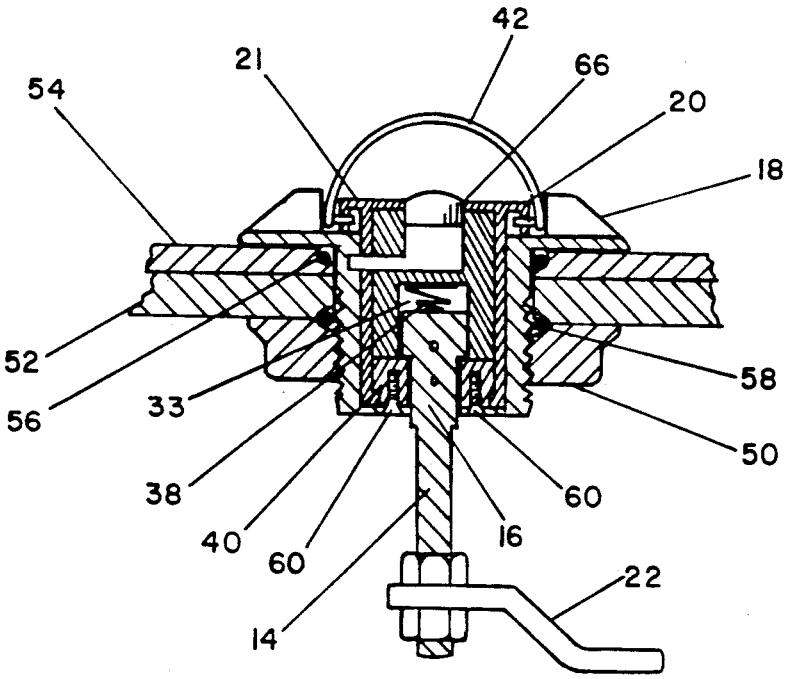
FIG. 5 is substantially the same as FIG. 4 except for the cavity of FIG. 5 having a plug in the top part thereof and showing no locking mechanism..
Figure 6:
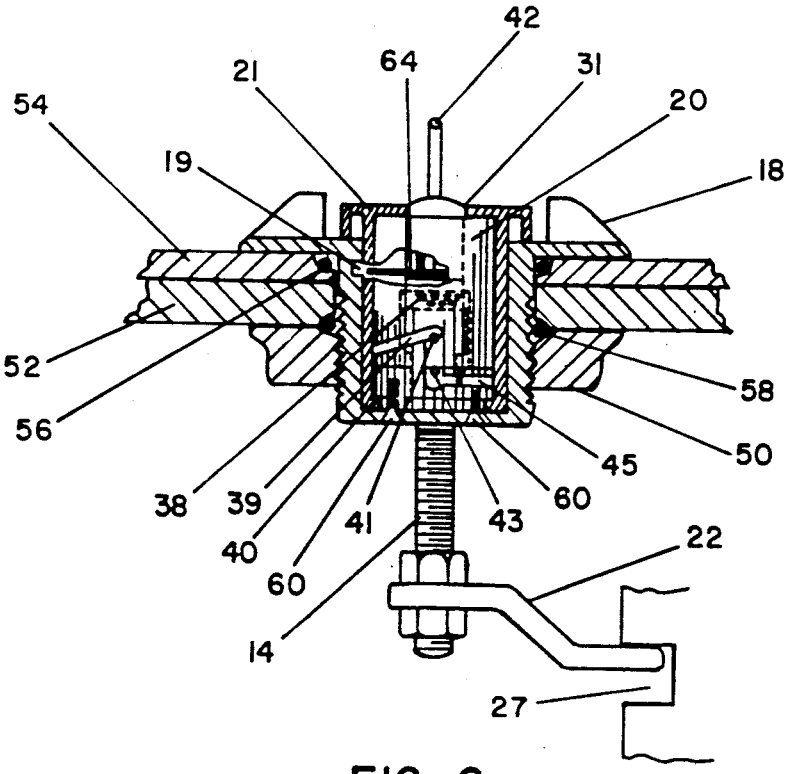
FIG. 6 is a longitudinal cross section of the hatch latch of the invention similar to that of FIG. 3 but with the inner shell and a fixed annular member therebelow in perspective and partly broken away to show one pin in a slot in the inner shell and another pin in a slot in the fixed annular member, the shaft and latch member being in an upper secured position, and with the inner shell broken away to show the locking mechanism, including the spring-loaded pin.

The latch, when it has a locking mechanism which includes the spring-loaded lock pin or rod 32 of FIG. 3 may be unlocked by turning key 62 from a locked position FIG. 3 to the unlocked position of FIG. 6. Then, by turning bail 42 and outer shell 21 and inner shell 20 therewith 90° counterclockwise, pin 41 moves along slot 39 assisted by spring 38 down with shaft 14, 16 from the position shown in FIG. 6 to the position shown in FIG. 7, and pin 43 in slot 45 and fixed lower annular member 40 moves at the same time from the same position (secure) shown in FIG. 6 without the shaft 14, 16 rotating. In this first 90° rotation, latch member 22 moves down with the shaft 14, 16 from a position shown in FIG. 6 where it touches striker plate 27 to the position shown in FIG. 7 where it is still in a latched position. By the aforesaid movement of the pins and downward movement of the shaft 14, 16 the shaft is effectively unlocked, so to speak, and enabled to rotate with the outer shell 21 and the inner shell 20 when the bail 42 is turned another 90° counterclockwise to the unlatched position of FIG. 8, pins 41 and 43 on shaft 16 now also being aligned in their new positions. Lower pin 43 limits the rotation of shaft 14, 16 to 90°.

Figure 7:
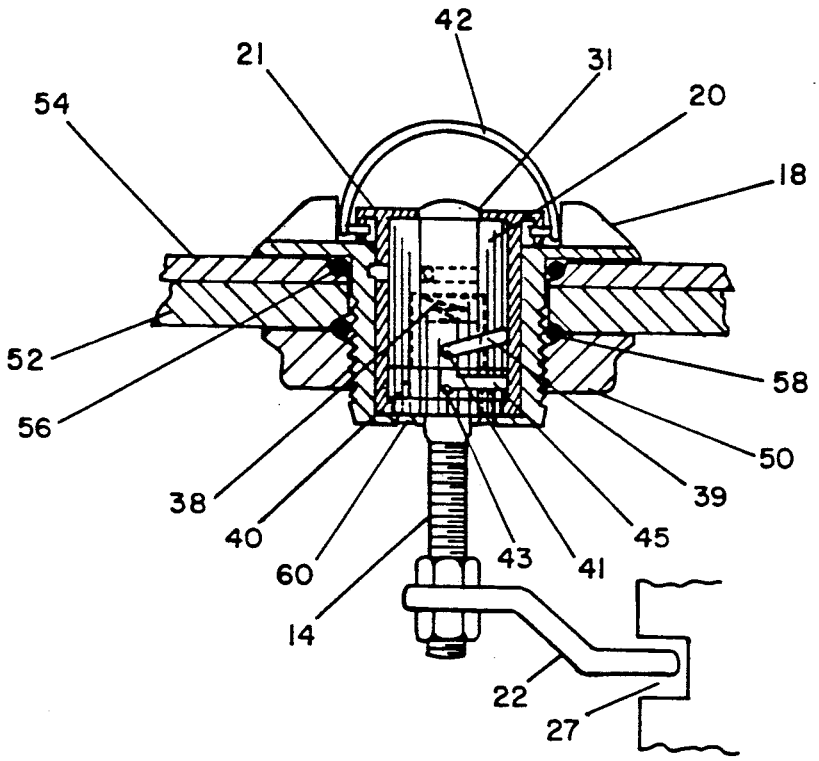
FIG. 7 is similar to FIG. 6 except for showing the pins and slots as they appear after rotating the outer shell with the inner shell from the secured position of FIG. 6 in which the latch member touches the striker plate to a lower latched position.
Figure 8:
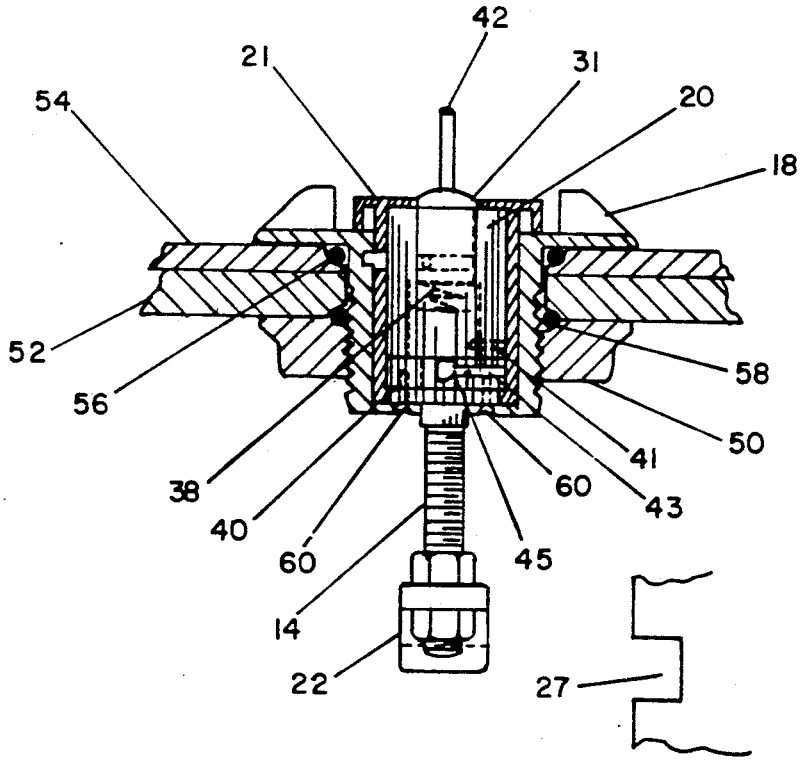
FIG. 8 is similar to FIG. 7 and shows the shaft and latch member in the same lower latched position, but rotated with the outer and inner shells another 90° counterclockwise to show the upper pin and the lower pin and slot as they appear after the rotation and the latch member in unlatched position with its main arm portion not visible as having turned 90° counterclockwise so as to be behind the shaft.

In going from the secured position of FIG. 6 to the latched but unsecured position of FIG. 7 upon turning outer shell 21 with inner shell 20 90° counterclockwise by rotating bail 42 90° counterclockwise, spring 38 forces pin 41 down in the 90° spiral groove, with the shaft 14, 16 moving downward. When the bail 42 is turned the second 90° counterclockwise the upper pin 41 is forced counterclockwise by the slot the full 90° to the unlatched position and the bottom pin 43 rides in lower slot 45, thereby permitting the shaft 14, 16 to turn to the unlatched position of FIG. 8.

The foregoing procedure is reversed when locking the hatch latch according to the invention, with the key-locking step being omitted if a plug 67 is used in cavity 66 instead of a locking mechanism when a hatch requires only secure latching without locking, the shaft being turned clockwise 90° in the first step to the latched but not secured position and the shaft being raised when turning the bail a second 90° clockwise to position the latch member 22 in a hatch latched and secured position.

Figure 2:
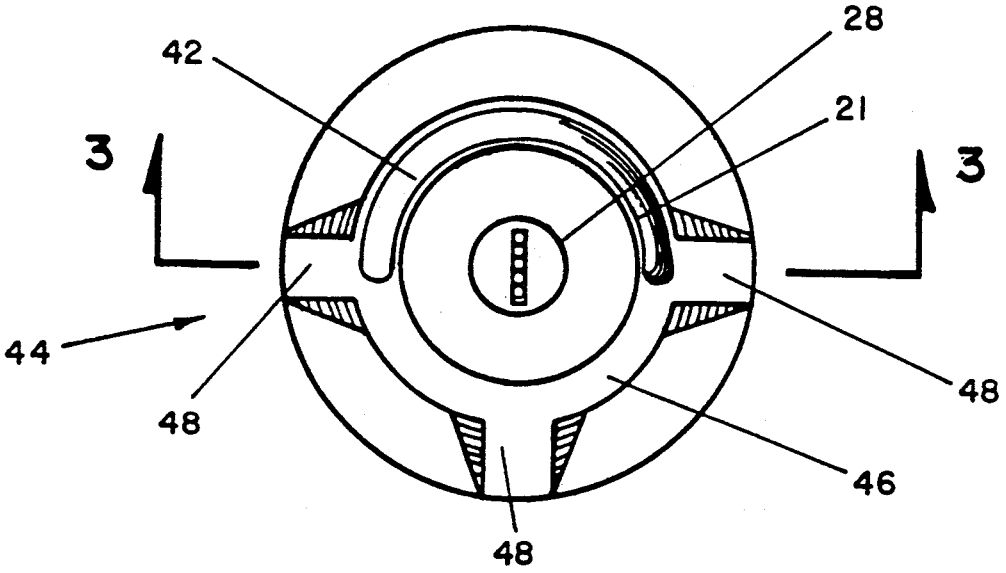
FIG. 2 is a top view of the hatch latch of the invention showing the waterproofing drainage slots and the bail used for rotating outer and inner shells.

With particular reference to FIG. 2, top surface 44 has a groove 46 surrounding cavity, plug or key cylinder 28 to shed water via at least one channel 48 off of surface 44 in a radial manner. Clamp nut 50 referred to hereinabove as an adjustable bolt, via threading fixes or tightens the hatch latch to hatch or hatch cover 52 (FIGS. 3 through 9) shown covered with carpet or linoleum or the like 54. Upper O-ring 56 and lower O-ring 58 help further in providing waterproofing by preventing water from leaking around the edge of the hole in which the hatch latch is inserted into a lower compartment.

The key unlocking and locking procedure according to the invention, involves first, turning the key in the key cylinder to its unlocked position (from which position the bail may be used to rotate the latch among all three positions, the up-secure, the down-latched and the down-unlatched.) And then turning the key back to its locked position, at which point the key may be removed, then will be locked without the key the hatch latch when the bail is turned to the latched and secure position.

In FIG. 6 the spring loaded rod or pin (32 of FIG. 3) is shown in an unlocked position "riding or floating around" the inside of outer shell 21 under spring tension until falling or springing into lock slot 19 as shown in FIG. 3.

A big advantage of the hatch latch of the invention is that a boatman can purchase it with the locking mechanism for as many hatches as he needs to lock with a plug instead of a locking mechanism for hatches he does not need to lock and still have the benefit of a secure latched position in addition to one which is not secured. A further advantage is that a user can move the latch back and forth to any latch member position easily both when it has the locking mechanism and is unlocked and when it has no locking mechanism but a plug instead.

While the invention has been described in terms of preferred embodiments, the claims appended hereto are intended to encompass all embodiments which fall within the spirit of the invention.

Having thus described my invention and certain preferred embodiments thereof, we claim:

1. A method for unlocking and locking a lockable hatch latch which comprises (1) turning a key in a spring-loaded pin-type key cylinder from a locked key to an unlocked key position from which a shaft of the latch may be moved down by turning a bail 90° counterclockwise to a shaft-down latched position and then by turning the bail 90° further counterclockwise thereby turning the shaft 90° counterclockwise to a shaft-down unlatched position, and thereafter, (2) turning the key back from the unlocked key shaft-up position to the locked key position and locking the latch in a locked secure position without using the key.

2. A method for latching and securing a hatch latch installed through an opening in a hatch which comprises turning a bail connected to an outer shell of said latch 90° clockwise, thereby rotating said outer shell and an inner shell and a shaft of said hatch latch which has a latch member extending perpendicularly from a lower portion thereof 90° clockwise from a shaft-down unlatched position to a shaft-down latched but not secured position and then turning said bail 90° further clockwise with accompanying movement 90° clockwise by said outer and inner shells, thereby raising said shaft to a latched and secured position in which said latch member touches a striker plate without turning said shaft.

3. A lockable hatch latch adapted to fit in a waterproof manner through a hatch, said latch comprising in cooperative association as an integral unit (1) an axial shaft having a lower portion and an upper portion, (2) a latching member extending perpendicularly from said lower portion of said shaft, (3) a housing surrounding said upper portion of said shaft, (4) an outer shell radially inside said housing, (5) an inner shell radially inside said outer shell and associated with said outer shell so as to rotate 90° counterclockwise with said outer shell from a shaft-up latch secured position to a shaft-down hatch latched position and to rotate further 90° counterclockwise this time with said shaft to a shaft-down position with said latching member unlatched, said inner shell having a 90° spiral slot with a pin therein, (6) a fixed annular member under said inner shell having a 90° L-shaped circular slot with a pin therein, (7) an axial chamber into which fits said upper portion of said shaft, (8) a compression spring above an upper surface of said shaft adapted to cooperate with said pins and said slots in lowering said shaft from said shaft-up latch secured position to said shaft-down latched position, (9) means for rotating said inner and outer shells said 90° counterclockwise from said shaft-up position to said shaft-down position and said further 90° counterclockwise with said shaft whereby said shaft is turned from said shaft-down latched position to said shaft-down position with said latching member unlatched,

(10) clamp nut means tightened against a lower surface of a hatch when said latch is installed through an opening in said hatch,

(11) a groove in an upper surface of said hatch latch around a center of said upper surface, said groove having at least one channel leading therefrom to a periphery of said surface whereby water will drain off of said surface.

4. The lockable hatch latch of claim 3 wherein a cavity contains a locking mechanism.

5. The lockable hatch latch of claim 4 wherein said locking mechanism comprises a lock pin operator mechanism and a spring-loaded pin.

6. The lockable hatch latch of claim 3 wherein a cavity contains a plug at a top of said cavity.

7. The lockable hatch latch of claim 3 having additionally at least one O-ring to aid waterproofing.

8. The lockable hatch latch of claim 3 having additionally an upper O-ring and a lower O-ring.

9. The lockable hatch latch of claim 3 wherein said means for rotating said outer and inner shells and said shaft with said latching member comprises a bail, each end of which is connected to a top portion of said outer shell.

* * * * *